US008408753B2

(12) United States Patent
Chen

(10) Patent No.: US 8,408,753 B2
(45) Date of Patent: Apr. 2, 2013

(54) LED LAMP WITH REFRACTIVE IMAGING EFFECT

(76) Inventor: Po-Chang Chen, Fongyuan (TW)

( * ) Notice: Subject to any disclaimer, the term of this patent is extended or adjusted under 35 U.S.C. 154(b) by 309 days.

(21) Appl. No.: 12/835,943

(22) Filed: Jul. 14, 2010

(65) Prior Publication Data

US 2012/0014113 A1 Jan. 19, 2012

(51) Int. Cl.
*F21V 3/00* (2006.01)
*F21V 3/02* (2006.01)
*F21V 5/00* (2006.01)

(52) U.S. Cl. ..... 362/311.1; 362/311.01; 362/311.02; 362/308; 362/309; 362/235

(58) Field of Classification Search ..... 362/311.01, 362/311.13, 333, 336, 338, 308, 309
See application file for complete search history.

(56) References Cited

U.S. PATENT DOCUMENTS

| | | | | |
|---|---|---|---|---|
| 5,757,557 | A * | 5/1998 | Medvedev et al. | 359/708 |
| 6,547,423 | B2 * | 4/2003 | Marshall et al. | 362/333 |
| 7,554,742 | B2 * | 6/2009 | Chinniah et al. | 359/641 |
| 7,748,872 | B2 * | 7/2010 | Holder et al. | 362/308 |
| 8,029,163 | B2 * | 10/2011 | Chen et al. | 362/308 |
| 8,033,690 | B1 * | 10/2011 | Shatz et al. | 362/309 |
| 2008/0291683 | A1 * | 11/2008 | Chinniah et al. | 362/326 |
| 2009/0014737 | A1 * | 1/2009 | Tsai et al. | 257/98 |
| 2009/0225552 | A1 * | 9/2009 | Chen | 362/333 |

* cited by examiner

*Primary Examiner* — Sikha Roy
(74) *Attorney, Agent, or Firm* — Rabin & Berdo, P.C.

(57) ABSTRACT

An LED lamp has a base, an LED device and a convex lens. The base has a recess. The LED device is mounted in the recess and has an LED. The convex lens is mounted in the recess, separates from the LED and has a cavity formed in the convex lens. The cavity has a bottom, an opening, an inner side surface and an imaging surface. Peripheries of the bottom and the opening of the cavity are wavy. The imaging surface is formed around the inner side surface, inclines from the bottom to the opening of the cavity and is wavy. The imaging surface is capable of refracting light emitted from the single one LED located in the cavity to form a characteristic visual effect like a chrysanthemum.

6 Claims, 6 Drawing Sheets

LED LAMP WITH REFRACTIVE IMAGING EFFECT

BACKGROUND OF THE INVENTION

1. Field of the Invention

The present invention relates to a lamp, and more particularly to an LED lamp having a characteristic visual effect.

2. Description of Related Art

A conventional LED lamp has a lens having a cavity axially formed in the lens. The cavity encompasses an LED and has an inner side surface and an imaging surface. The imaging surface is formed around the inner side surface of the cavity and is capable of refracting light emitted from the LED. However, the imaging surface of the cavity is not wavy and can not refract light emitted from the LED to form a characteristic image, such as a chrysanthemum. Accordingly, a visual effect of the conventional LED lamp is poor.

To overcome the shortcomings, the present invention tends to provide an LED lamp to mitigate the aforementioned problems.

SUMMARY OF THE INVENTION

The main objective of the invention is to provide an LED lamp having a characteristic visual effect.

An LED lamp has a base, an LED device and a convex lens. The base has a recess. The LED device is mounted in the recess and has an LED. The convex lens is mounted in the recess, separates from the LED and has a cavity formed in the convex lens. The cavity has a bottom, an opening, an inner side surface and an imaging surface. Peripheries of the bottom and the opening of the cavity are wavy. The imaging surface is formed around the inner side surface, inclines from the bottom to the opening of the cavity and is wavy. The imaging surface is capable of refracting light emitted from the single one LED located in the cavity to form a characteristic visual effect like a chrysanthemum.

Other objects, advantages and novel features of the invention will become more apparent from the following detailed description when taken in conjunction with the accompanying drawings.

DETAILED DESCRIPTION OF PREFERRED EMBODIMENT

Figure 1:
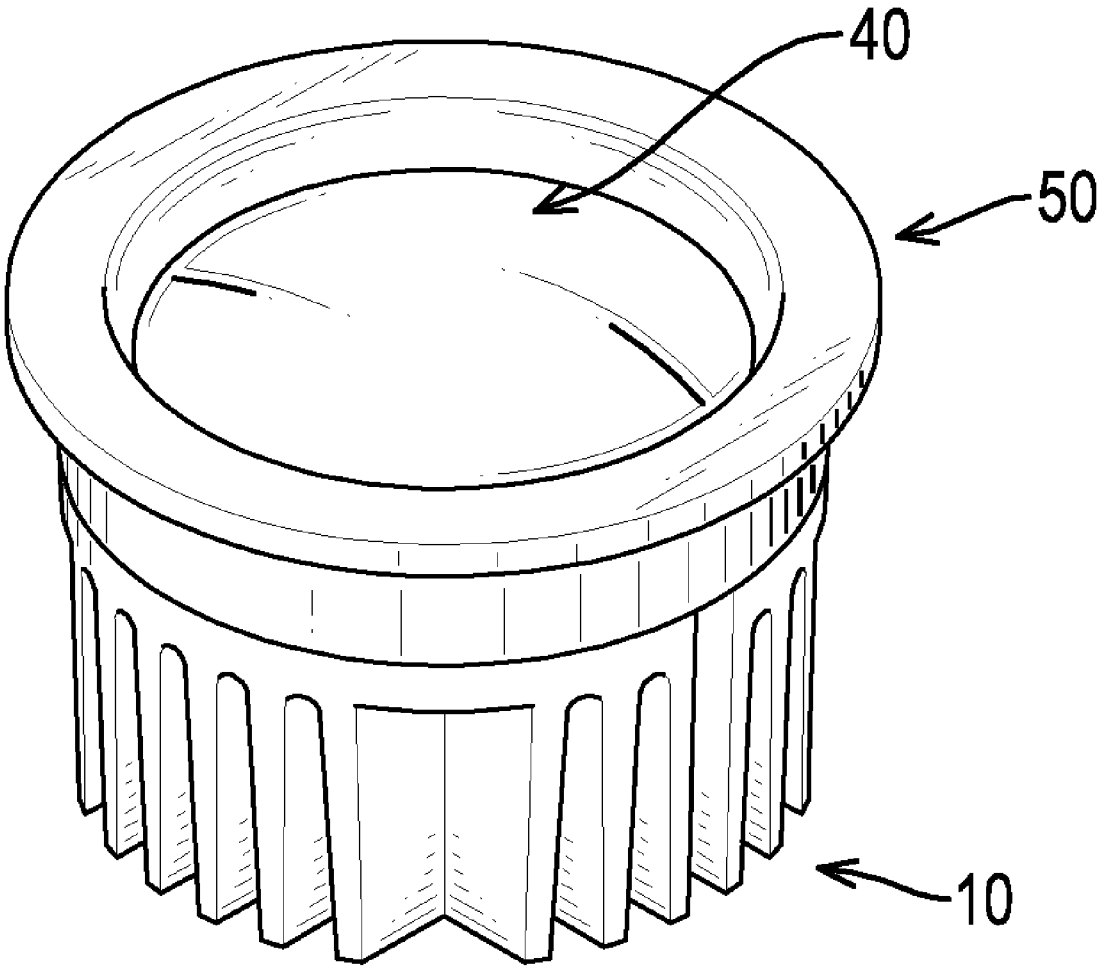
FIG. 1 is a perspective view of an LED lamp in accordance with the present invention.
Figure 2:
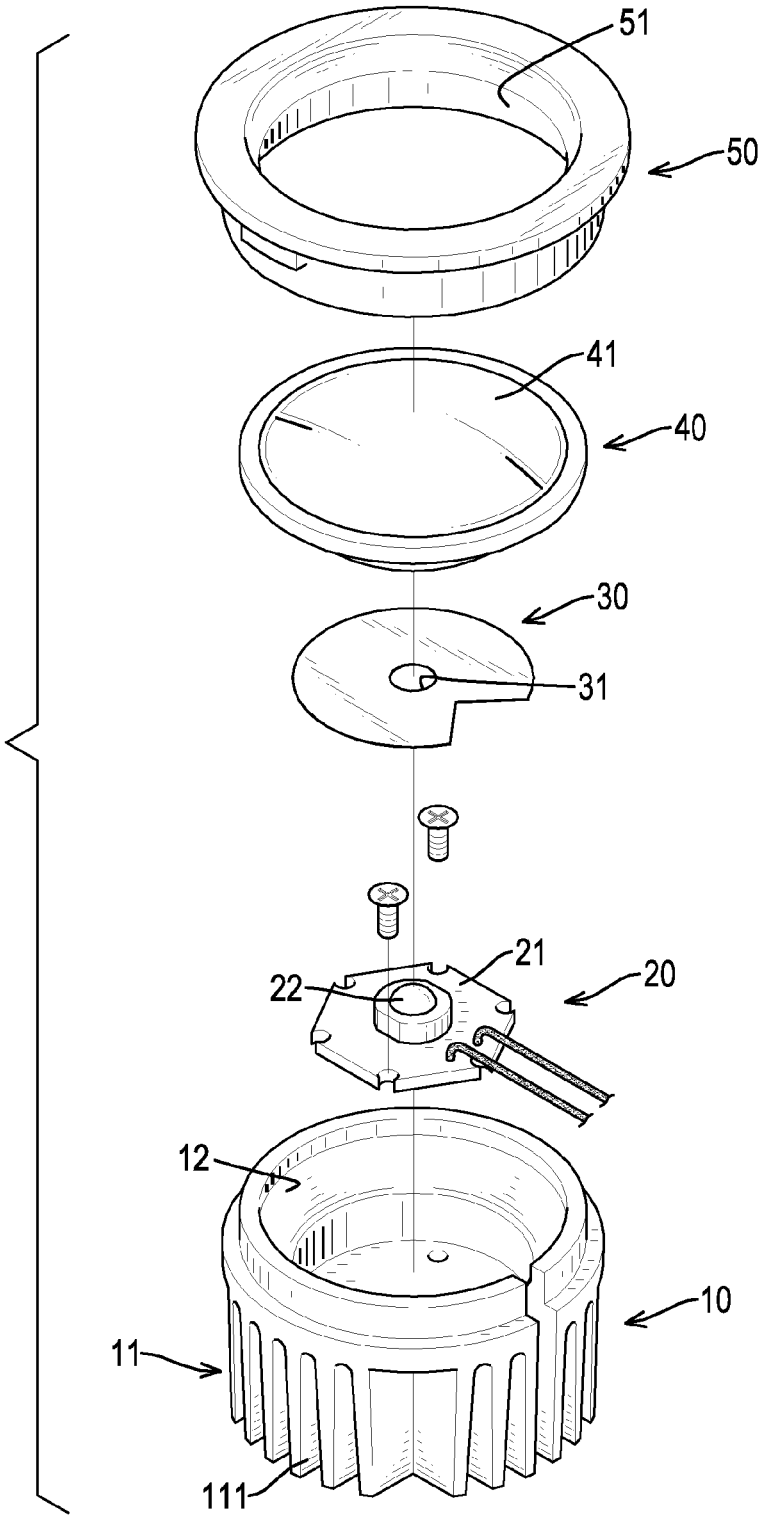
FIG. 2 is a partially exploded perspective view of the LED lamp in FIG. 1.
Figure 3:
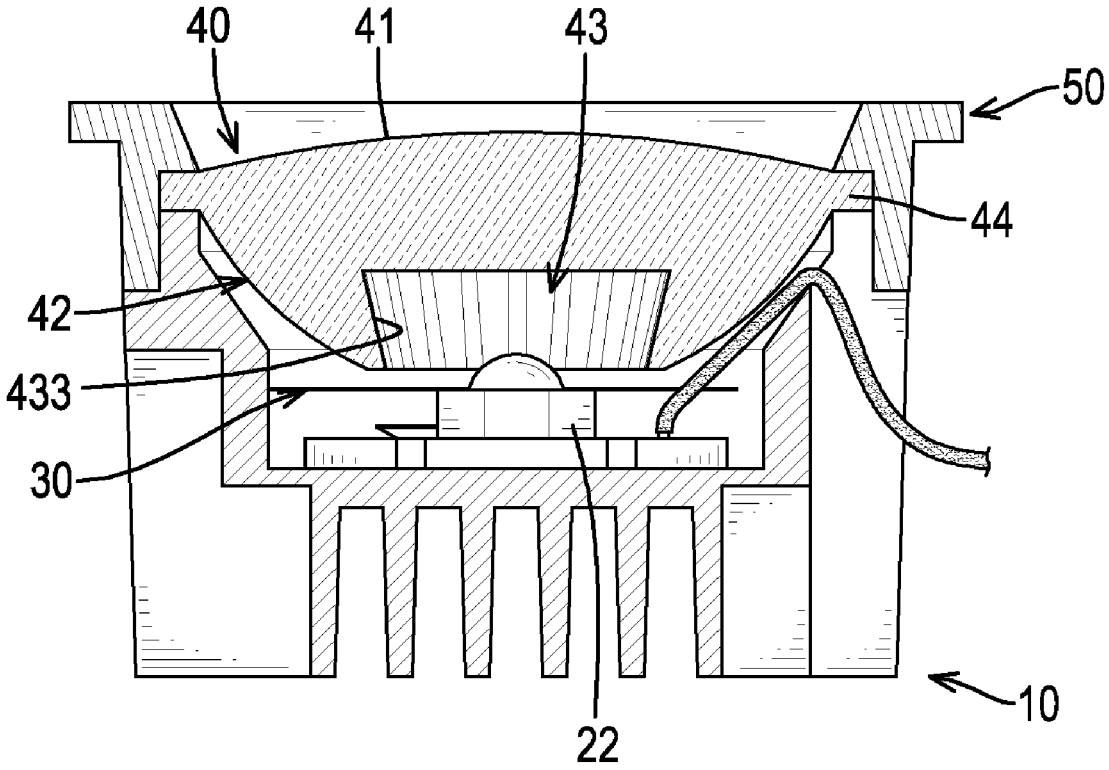
FIG. 3 is an enlarged side view in partial section of the LED lamp in FIG. 1.

With reference to FIGS. 1 to 3, an LED lamp in accordance with the present invention comprises a base 10, an LED device 20, a reflector 30, a convex lens 40 and a cover 50.

The base 10 is a round chunk and has a first end, a second end, a heat sink section 11 and a recess 12. The second end of the base 10 is opposite to the first end of the base 10. The heat sink section 11 is formed at the second end of the base 10 and has multiple fins 111 to dissipate heat. The recess 12 is formed in the first end of the base 10 and has a bottom.

The LED device 20 is mounted securely in the recess 12 and has a circuit board 21 and an LED 22. The circuit board 21 is mounted securely on the bottom of the recess 12 and has a surface opposite to the bottom of the recess 12. The LED (light emitting diode) 22 is mounted securely on the surface of the circuit board 21 and is electrically connected with the circuit board 21.

The reflector 30 is a foil, is mounted on the surface of the circuit board 21 beside the LED 22 and has a reflector hole 31. The reflector 31 is axially formed through the reflector 31 and is mounted around the LED 22. The base 10, the LED device 20 and the reflector 30 may be conventional and detailed description thereof is omitted.

Figure 4:
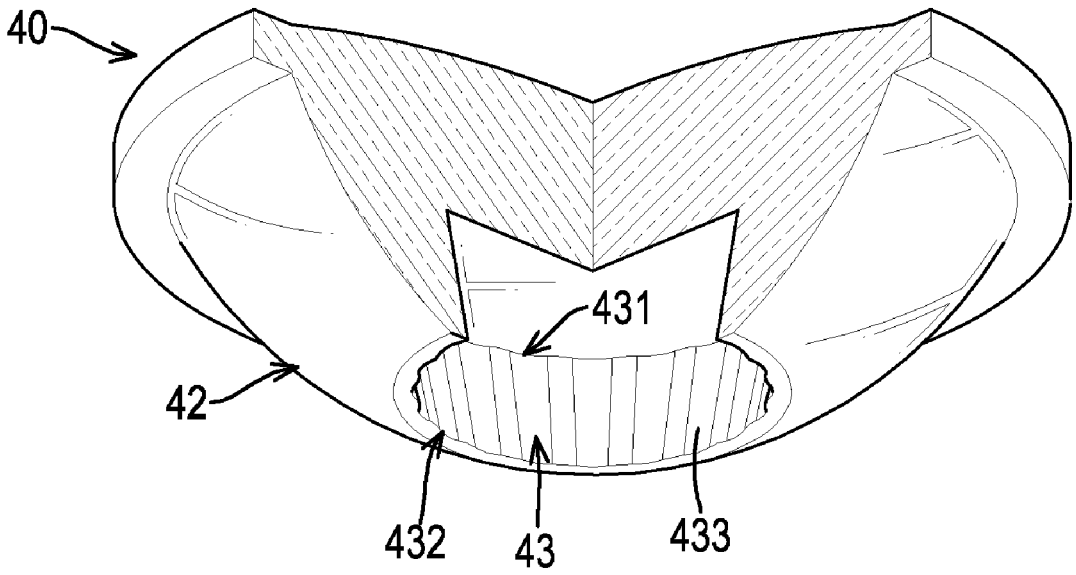
FIG. 4 is an enlarged perspective view in partial section of the convex lens in FIG. 1.
Figure 5:
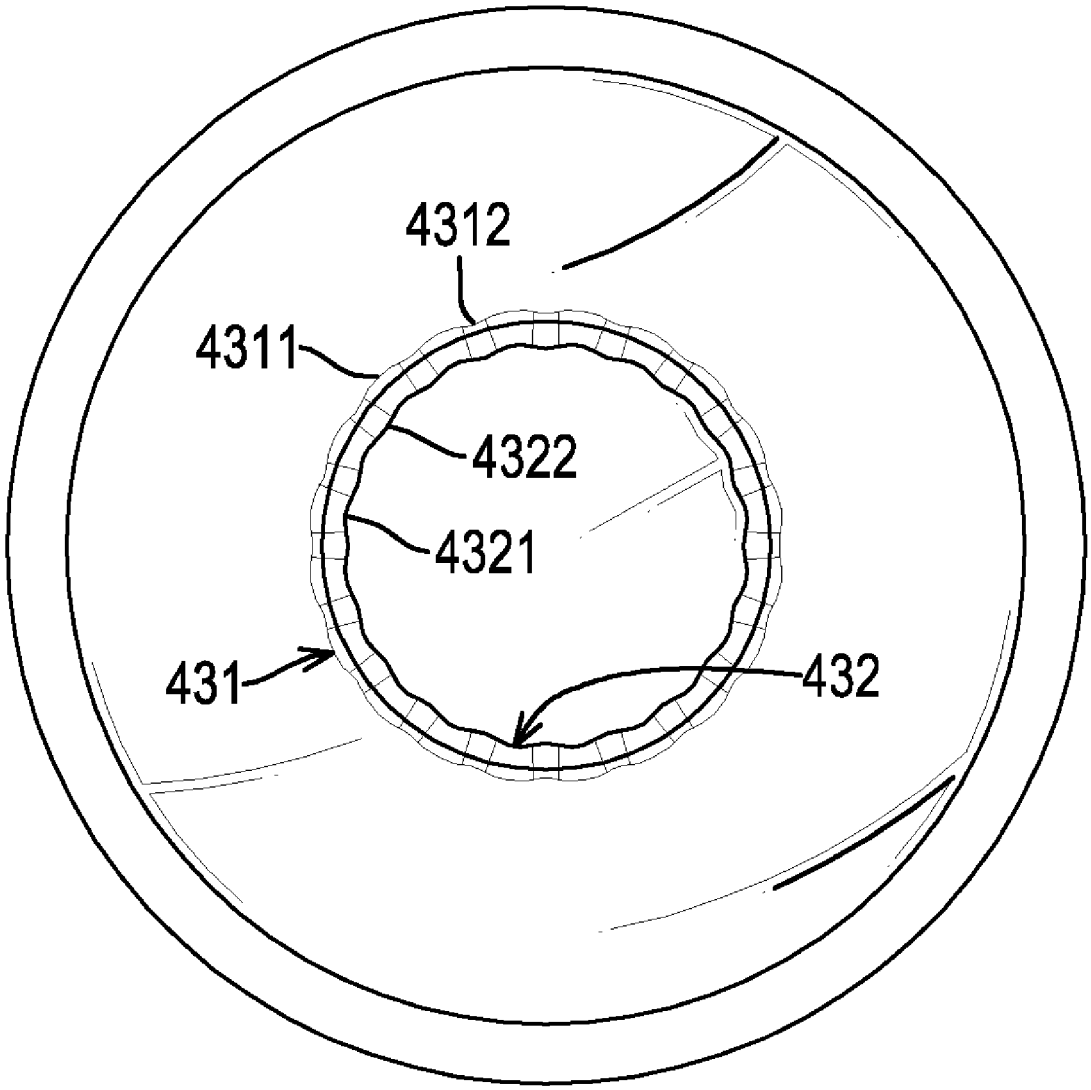
FIG. 5 is an enlarged bottom view of the convex lens in FIG. 4.

With further reference to FIGS. 4 and 5, the convex lens 40 is a transparent round lens, is connected securely with the first end of the base 10, is mounted above the LED device 20 and has a first end, a second end, an outer surface, a convex section 41, an imaging section 42, a cavity 43 and a protrusion 44.

The second end of the convex lens 40 is opposite to the first end of the lens 40 and faces the LED 22. The convex section 41 is formed at the first end of the lens 40. The imaging section 42 is formed at the second end of the lens 40 and is bowl-shaped.

The cavity 43 is axially formed in the imaging section 42, encompasses the LED 22 and has a bottom, an opening, an inner side surface, a first edge 431, a second edge 432 and an imaging surface 433. The bottom of the cavity 43 is flat and has a periphery. The opening of the cavity 43 is opposite to the bottom of the cavity 43 and has a periphery. Preferably, the periphery of the opening of the cavity 43 is smaller than that of the bottom of the cavity 43.

The first edge 431 is formed around the periphery of the bottom of the cavity 43, is wavy and has multiple first convex arcs 4311 and multiple first concave arcs 4312. The first convex arcs 4311 are spaced at intervals at the periphery of the bottom of the cavity 43. The first concave arcs 4312 are spaced at intervals at the periphery of the bottom of the cavity 43 beside the first convex arcs 4311.

The second edge 432 is formed around the periphery of the opening of the cavity 43, is wavy and has multiple second convex arcs 4321 and multiple second concave arcs 4322. The second convex arcs 4321 respectively align with the first convex arcs 4311 and are spaced at intervals at the periphery of the opening of the cavity 43. The second concave arcs 4322 are formed at intervals at the periphery of the opening of the cavity 43 beside the second convex arcs 4321 and respectively align with the first concave arcs 4312. Preferably, each first convex arc 4311 has an arc length and each second convex arc 4321 has an arc length smaller than that of each first convex arc 4311. Each first concave arc 4312 has an arc length and each second concave arc 4322 has an arc length larger than that of each first concave arc 4312.

Figure 6:
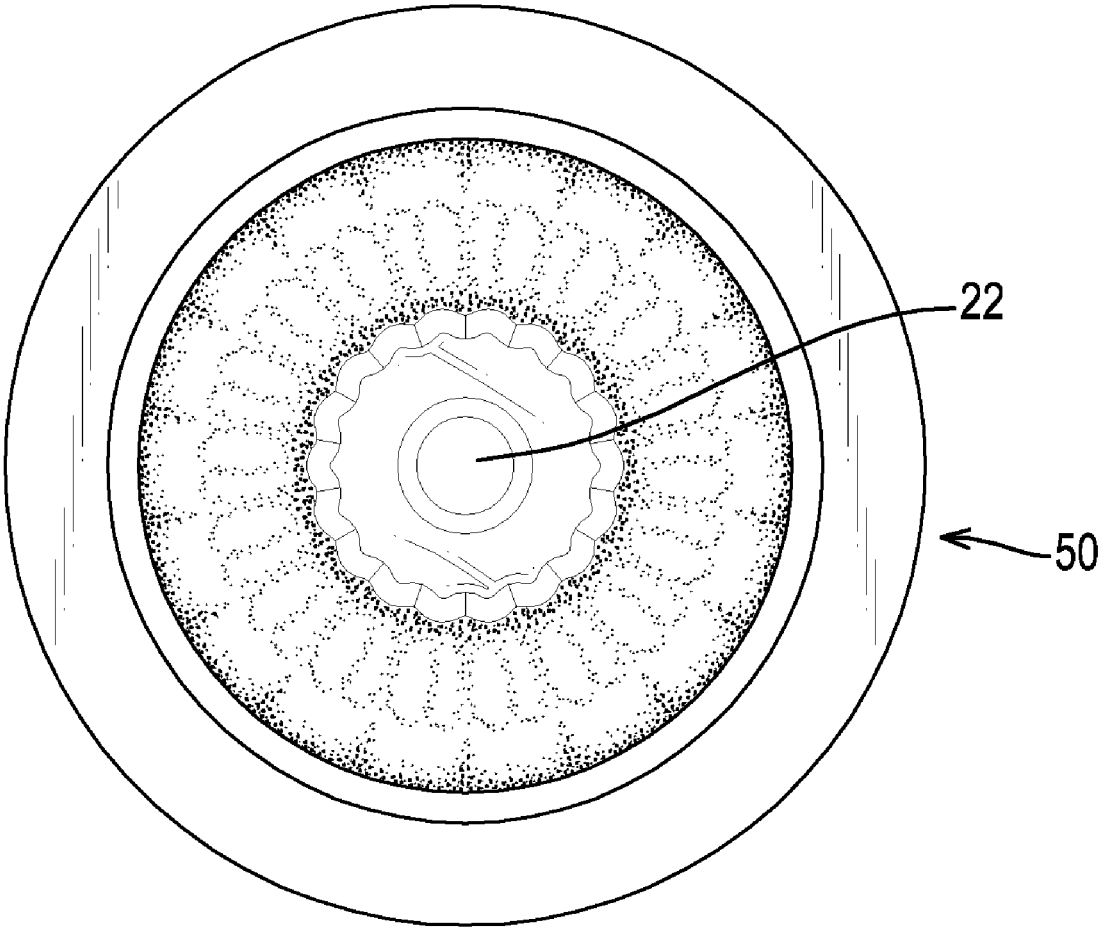
FIG. 6 is an enlarged operational top view of the LED lamp in accordance with the present invention in FIG. 1.

The imaging surface 433 is formed around the inner side surface of the cavity 43, inclines from the first edge 431 to the second edge 432 of the cavity 43 relative to an axis of the cavity and is wavy because the first edge 431 and the second edge 432 are wavy. The imaging surface 433 has a cross sectional edge conforming with the first edge 431 and the second edge 432 of the cavity 43 in shape. With further reference to FIG. 6, the imaging surface 433 is capable of refracting light emitted from the single one LED 22 located in the cavity 43 to form a characteristic visual effect like a chrysanthemum.

The protrusion 44 is annular, is formed around and protrudes radially from the outer surface of the convex lens 40.

The cover 50 is round, is combined securely with the first end of the base 10 with clue and clamps the protrusion 44 with the base 10 to secure the convex lens 40 between the cover 50 and the base 10. The cover 50 has a cover hole 51 formed axially through the cover 50 to allow users to see the visual effect of the chrysanthemum.

The LED 22 can emit light having any possible color. If the color of the LED 22 is yellow, a top view of the LED lamp in accordance with the present invention looks like a yellow chrysanthemum.

From the above description, it is noted that the present invention has the following advantages:

1. Forming a Characteristic Visual Effect:

The imaging surface 433 is capable of refracting light emitted from the single one LED 22 located in the cavity 43 to form a characteristic visual effect like a chrysanthemum.

2. Soft Lighting:

Because light emitted from the LED 22 is scattered by the imaging surface 433, light emitted from the LED 22 does not concentrate and the lighting of the LED lamp in accordance with the present invention is soft and will not be harsh to eyes.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

a base having a first end and a recess formed in the first end of the base;

an LED device mounted in the recess and having a circuit board, and an LED electrically connected with the circuit board;

a transparent convex lens connected securely with the first end of the base, mounted in the recess, separated from the LED device, and having a first end;

a second end opposite to the first end of the convex lens;

a convex section formed at the first end of the convex lens;

an imaging section formed at the second end of the convex lens; and a cavity axially formed in the imaging section, encompassing the LED, and having a bottom having a periphery;

an opening opposite to the bottom of the cavity and having a periphery;

an inner side surface;

a first edge formed around the periphery of the bottom of the cavity, and having multiple first convex arcs spaced at intervals at the periphery of the bottom of the cavity, and each respectively having an arc length; and multiple first concave arcs spaced at intervals at the periphery of the bottom of the cavity beside the first convex arcs;

a second edge formed around the periphery of the opening of the cavity and having multiple second convex arcs spaced at intervals at the periphery of the opening of the cavity, and respectively having an arc length, wherein the arc length of each second convex arc is smaller than that of each first convex arc: and multiple second concave arcs spaced at intervals at the periphery of the opening of the cavity beside the second convex arcs; and an imaging surface formed around the inner side surface of the cavity, inclining from the first edge to the second edge of the cavity relative to an axis of the cavity, and having a cross sectional edge conforming with the first edge and the second edge of the cavity in shape.

2. The LED lamp as claimed in claim 1, wherein the second convex arcs respectively align with the first convex arcs.

3. The LED lamp as claimed in claim 2, wherein the periphery of the opening of the cavity is smaller than that of the bottom of the cavity.

4. The LED lamp as claimed in claim 3, wherein the bottom of the cavity is flat.

5. The LED lamp as claimed in claim 1, wherein the periphery of the opening of the cavity is smaller than that of the bottom of the cavity.

6. The LED lamp as claimed in claim 1, wherein the bottom of the cavity is flat.

* * * * *